US011231172B1

(12) United States Patent
Wu et al.

(10) Patent No.: US 11,231,172 B1
(45) Date of Patent: Jan. 25, 2022

(54) LED LAMP BULB WITH CONDUCTIVE ELEMENT INSERTED IN SELF-LOCKING ELEMENT

(71) Applicant: ZHANGZHOU GO WIN LIGHTING CO., LTD., Zhangzhou (CN)

(72) Inventors: Qingan Wu, Zhangzhou (CN); Xiongzhong Lin, Zhangzhou (CN); Yaying Huang, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/231,008

(22) Filed: Apr. 15, 2021

(30) Foreign Application Priority Data

Feb. 7, 2021 (CN) ..... 202110177591.X

(51) Int. Cl.

| | |
|---|---|
| ***F21V 31/00*** | (2006.01) |
| ***F21V 23/06*** | (2006.01) |
| ***F21V 23/00*** | (2015.01) |
| ***F21V 17/12*** | (2006.01) |
| ***F21K 9/232*** | (2016.01) |
| ***F21K 9/238*** | (2016.01) |
| ***F21K 9/235*** | (2016.01) |
| *F21Y 115/10* | (2016.01) |

(52) U.S. Cl.
CPC ..... *F21V 31/005* (2013.01); *F21K 9/232* (2016.08); *F21K 9/235* (2016.08); *F21K 9/238* (2016.08); *F21V 17/12* (2013.01); *F21V 23/005* (2013.01); *F21V 23/06* (2013.01); *F21Y 2115/10* (2016.08)

(58) Field of Classification Search
CPC ..... F21K 9/232; F21K 9/235; F21K 9/238; F21K 9/66
See application file for complete search history.

(56) References Cited

U.S. PATENT DOCUMENTS

| | | | | |
|---|---|---|---|---|
| 8,786,193 | B2 * | 7/2014 | Hsin | F21K 9/232 315/113 |
| 9,739,471 | B1 * | 8/2017 | Chen | F21K 9/232 |
| 10,047,928 | B2 * | 8/2018 | Chen | F21K 9/238 |
| 10,094,550 | B2 * | 10/2018 | Chen | F21K 9/238 |
| 10,197,230 | B2 * | 2/2019 | Knapp | F21K 9/238 |
| 10,274,185 | B2 * | 4/2019 | Kato | F21K 9/232 |
| 10,690,292 | B1 * | 6/2020 | Cao | F21K 9/238 |
| 10,718,470 | B1 * | 7/2020 | Wu | F21K 9/235 |
| 10,753,595 | B1 * | 8/2020 | Wan | F21K 9/235 |
| 11,125,430 | B1 * | 9/2021 | Wu | F21K 9/238 |
| 2017/0336063 | A1 * | 11/2017 | Leung | F21V 23/001 |
| 2019/0072237 | A1 * | 3/2019 | Huang | F21K 9/232 |
| 2020/0332963 | A1 * | 10/2020 | Wu | F21K 9/232 |

* cited by examiner

*Primary Examiner* — Ismael Negron

(57) ABSTRACT

A lamp bulb including a lampshade with an open end, a light-emitting circuit board arranged in the lampshade, a light emitting diode provided on the circuit board, a silicone washer, and a lamp holder fixing the silicon washer and the circuit board to the open end of the lampshade in a waterproof arrangement. A self-locking element is fixed to a power port of the light-emitting circuit board, and is configured to receive a rod-shaped first conductive element passing through a hole in the silicone washer. A second conductive element is fixed to a second power port of the light-emitting circuit board, and to the lamp holder.

10 Claims, 8 Drawing Sheets

LED LAMP BULB WITH CONDUCTIVE ELEMENT INSERTED IN SELF-LOCKING ELEMENT

CROSS REFERENCE TO RELATED APPLICATIONS

This application is based upon and claims priority to Chinese Patent Application No. 202110177591.X, filed on Feb. 7, 2021, the entire contents of which are incorporated herein by reference.

TECHNICAL FIELD

The present disclosure relates to the field of lamps, and in particular to waterproof lamps.

BACKGROUND

As a common device for daily lighting and background heightening, lamps are widely used in various scenes. Waterproof performance is one of the most important factors that restrict the service life of lamps. Inevitably, lamps get wet or moist air travels in the lamps in rainy or humid weather when the lamps are used outdoors, which seriously affects the service life of lamps, and may even cause the lamp bulb to burst.

In the prior art, one main solution to avoid water ingress of the lamps is to configure a lampshade to prevent raindrops from falling straight on the lamp bulb. However, the application scenarios will be somehow limited by using such solution. Therefore, how to improve the self-waterproof performance of the lamps is a subject of positive and practical significance.

SUMMARY OF DISCLOSURE

In order solve the above-mentioned issues, one objective of the present disclosure is to provide a waterproof lamp with good waterproof performance, good practicability and reliability, low cost and convenient installation.

In order to achieve the above technical objectives, the present disclosure provides the following technical solutions.

A waterproof lamp includes:

a lampshade, the lampshade has a hollow structure with an open end and is internally provided with a light source installation cavity;

a light-emitting circuit board, the light-emitting circuit board is arranged in the light source installation cavity of the lampshade, a neutral wire inlet port and a live wire inlet port for connecting with a neutral wire and a live wire of a power supply are arranged on a first end of the light-emitting circuit board, and a light emitting element is arranged on a second end of the light-emitting circuit board;

a waterproof silicone washer, the waterproof silicone washer is connected to the open end of the lampshade and is fixedly connected to the light-emitting circuit board to fix the light-emitting circuit board in the light source installation cavity; and a lamp holder, the lamp holder is mounted around an outer wall of the open end of the lampshade to fasten the waterproof silicone washer on the lampshade.

The waterproof lamp further includes:

a self-locking element fixed on the live wire inlet port of the light-emitting circuit board;

a first conductive element, the first conductive element is rod-shaped, a first end of the first conductive element is attached and fixed with the self-locking element by insertion, a second end of the first conductive element vertically passes through the waterproof silicone washer and is exposed outside the waterproof silicone washer, the waterproof silicone washer is correspondingly provided with a through hole for the first conductive element to pass through, the through hole and a first part of the first conductive element that passes through the through hole have an interference fit, an end of the lamp holder corresponding to the second end of the first conductive element is provided with an avoidance hole, and an inner edge of the avoidance hole is spaced with the second end of the first conductive element;

a second conductive element, the second conductive element is made of conductive wire, a first end of the second conductive element is fixedly connected to the neutral wire inlet port of the light-emitting circuit board, and a second end of the second conductive element is led out of the lampshade and is electrically connected to the lamp holder.

As an optional implementation, further, the self-locking element is tube-shaped and is made of a conductive material, an outer side of the self-locking element is fixedly connected to the live wire inlet port of the light-emitting circuit board, and the first end of the first conductive element is attached and fixed in a tube structure of the self-locking element by insertion.

As a preferred embodiment, the self-locking element is provided with an elastic engaging part. The elastic engaging part obliquely extends along and gradually gets close to an axis of the self-locking element. A second part of the first conductive element that passes through the self-locking element is provided with a diminishing segment. The diminishing segment is located close to a terminal of the second part of the first conductive element that passes through the self-locking element. The diminishing segment is engaged and locked with the elastic engaging part.

As an optional implementation, further, the second end of the first conductive element is provided with a conductive portion having a curved structure.

As an optional implementation, further, the outer wall of the open end of the lampshade is provided with external threads, an inner wall of the lamp holder is provided with internal threads, and the lamp holder is threaded on the outer wall of the open end of the lampshade through the internal threads.

As an optional implementation, further, the waterproof silicone washer includes a silicone washer main body. The silicone washer main body has a columnar structure. A first end of the silicone washer main body passes into an inner side of the open end of the lampshade, and the first end of the silicone washer main body is provided with a profiling insertion groove matched with a structure of a first end of the light-emitting circuit board, and the first end of the light-emitting circuit board is inserted into the profiling insertion groove. An outer wall of a second end of the silicone washer main body is provided with an annular extension portion set on a terminal edge of the open end of the lampshade.

As a preferred embodiment, a center of the second end of the silicone washer main body is provided with a projection corresponding to the avoidance hole of the lamp holder. The projection extends partially out of the avoidance hole. The second end of the first conductive element passes through the projection to be exposed outside the waterproof silicone washer.

As a preferred implementation, the present disclosure further includes an inner lens. The inner lens is arranged inside the lampshade. An end of the inner lens is connected and fixed on an outer wall of the first end of the silicone washer main body connected to the light-emitting circuit board. The light-emitting circuit board is covered inside the inner lens.

As an optional implementation, further, the second end of the second conductive element is led out of the lampshade from a gap between the outer wall of the silicone washer main body and the inner wall of the open end of the lampshade, and the second end of the second conductive element passes through a gap between the inner wall of the lamp holder and the outer wall of the open end of the lampshade to be partially exposed outside the lamp holder.

As an optional implementation, further, the second conductive element is made of copper, iron or aluminum.

As an optional implementation, further, the light-emitting element is an LED lamp bead. An edge of the second end of the light-emitting circuit board is provided with a pair of semi-circular through holes. The pair of semi-circular through holes are each provided with a conductive film. The conductive films in the pair of semi-circular through holes are each connected to a power supply output end of the light-emitting circuit board. The conductive films in the pair of semi-circular through holes are respectively and electrically connected to a positive pin and a negative pin of the LED lamp bead in an one-to-one correspondence.

Compared with the prior art, the above-mentioned technical solution of the present disclosure has the following beneficial effects. Taking the drawbacks that the traditional lamp holder has poor waterproof performance into consideration, in the present disclosure, a waterproof silicone washer is arranged on an open end of the lampshade, and then the lampshade is tightly locked with a lamp holder, so as to greatly improve the sealing performance of the engagement between the lamp holder and the lampshade. Further, a self-locking element is provided on the light-emitting circuit board to connect with the live wire connector (i.e., the first conductive element) of the lamp. The first conductive element passes through the waterproof silicone washer with an interference fit, so that the live wire inlet port of the light-emitting circuit board has a better waterproof and sealing performance while a better attachment between the light-emitting circuit board and the lamp holder is achieved. An end of the first conductive element extending out of the waterproof silicone washer is provided with a conductive portion, which can eliminate the traditional tin soldering process, thereby simplifying the assembly process and improving the convenience and installation efficiency while having the advantages of good waterproof performance of the lamp.

BRIEF DESCRIPTION OF DRAWINGS

In order to provide a clearer description of the technical scheme of the present disclosure, the drawings used to illustrate the embodiments or the prior art will be briefly described below. It should be understood that, the drawings below merely show some of the embodiments of the present disclosure, and therefore should not be regarded as limits to the scope of the present disclosure. For those of ordinary skill in the art, other related drawings may be derived according to the drawings shown without any creative efforts.

DETAILED DESCRIPTION

Figure 1:
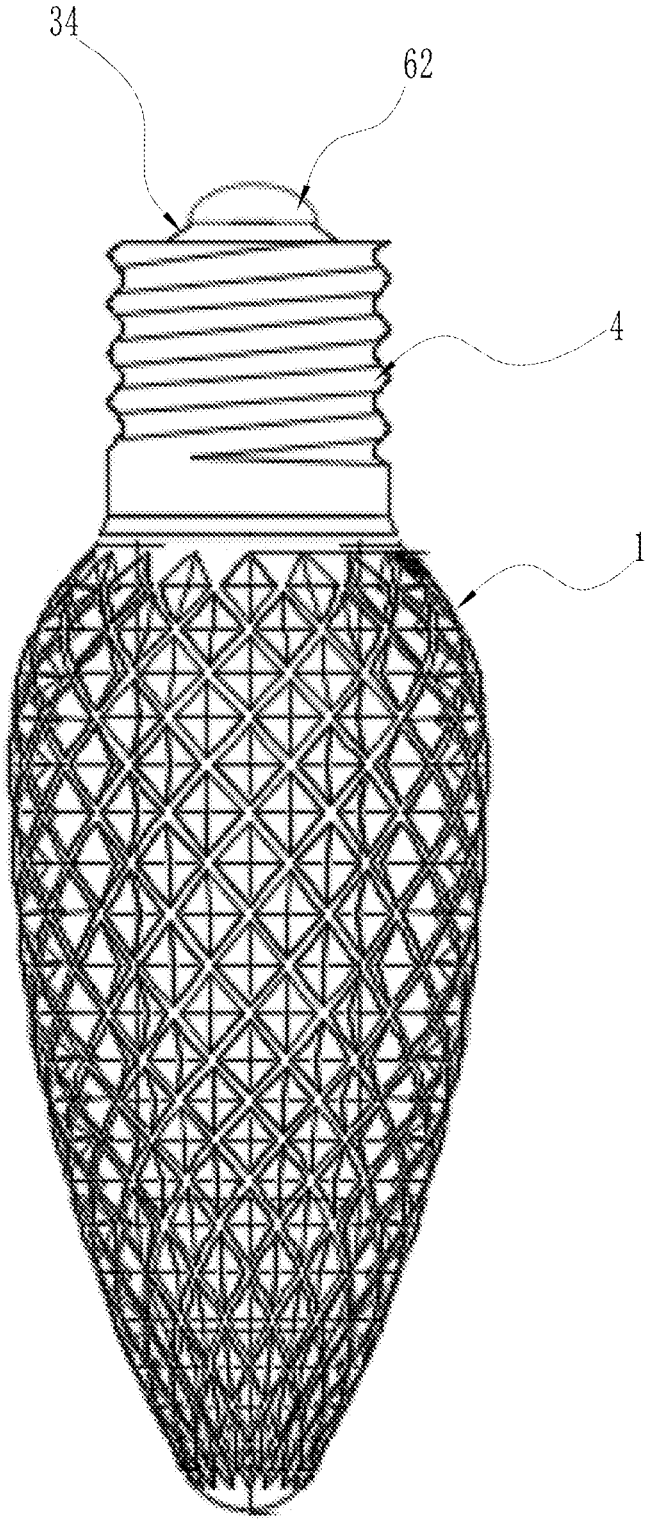
FIG. 1 is a structural schematic diagram according to a first embodiment of the present disclosure.
Figure 2:
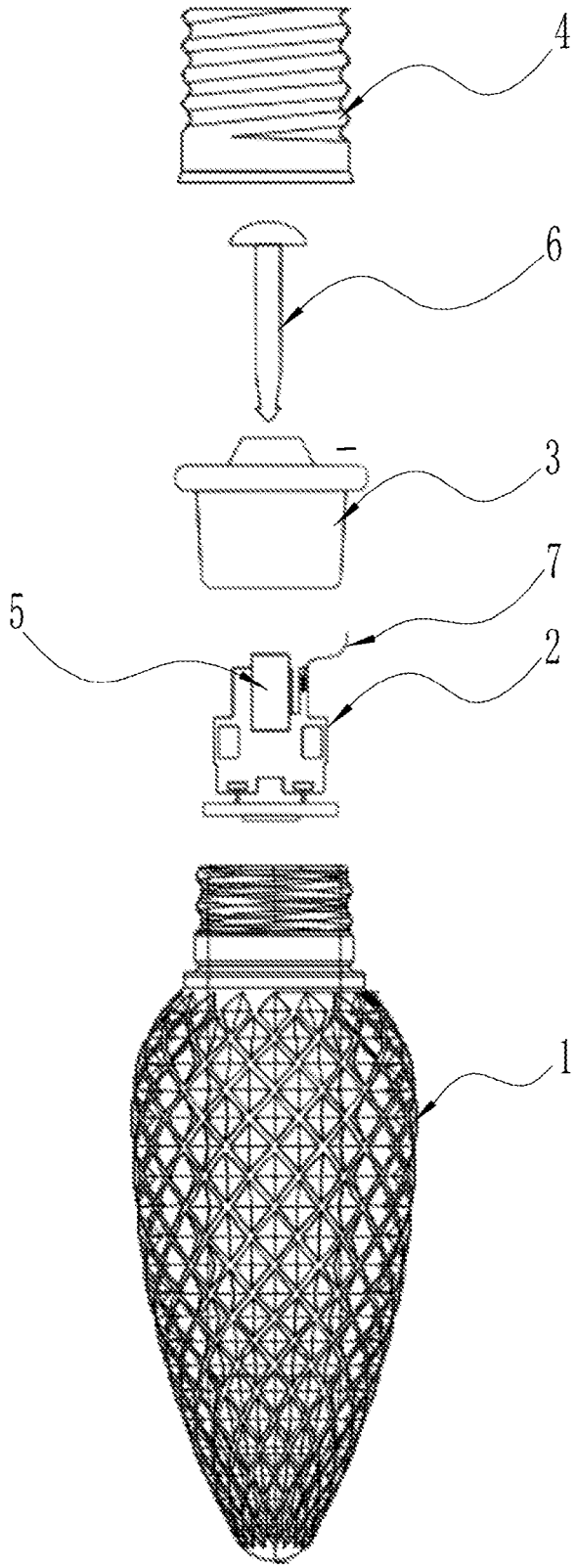
FIG. 2 is an exploded structural schematic diagram according to the first embodiment of the present disclosure.
Figure 3:
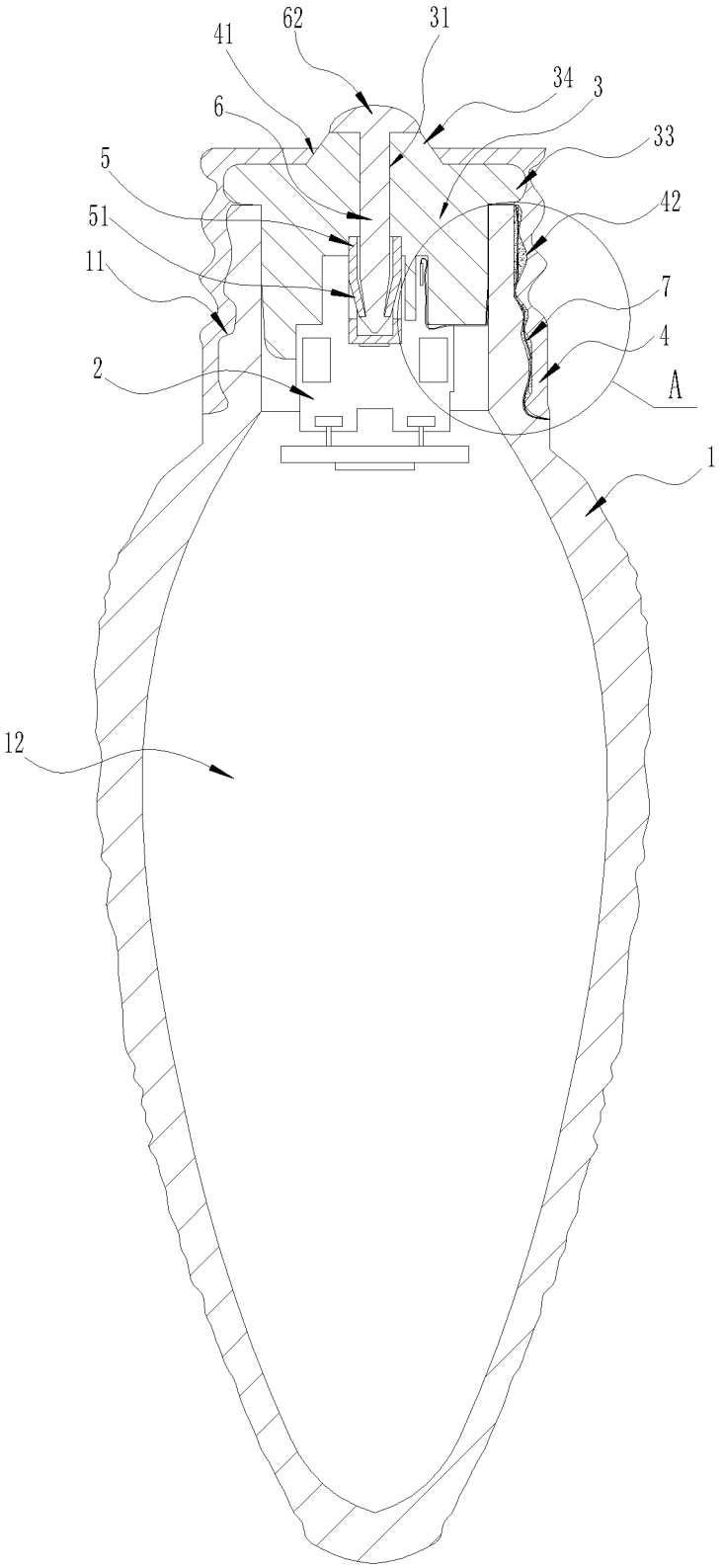
FIG. 3 is a cross-sectional structural schematic diagram according to the first embodiment of the present disclosure.
Figure 4:
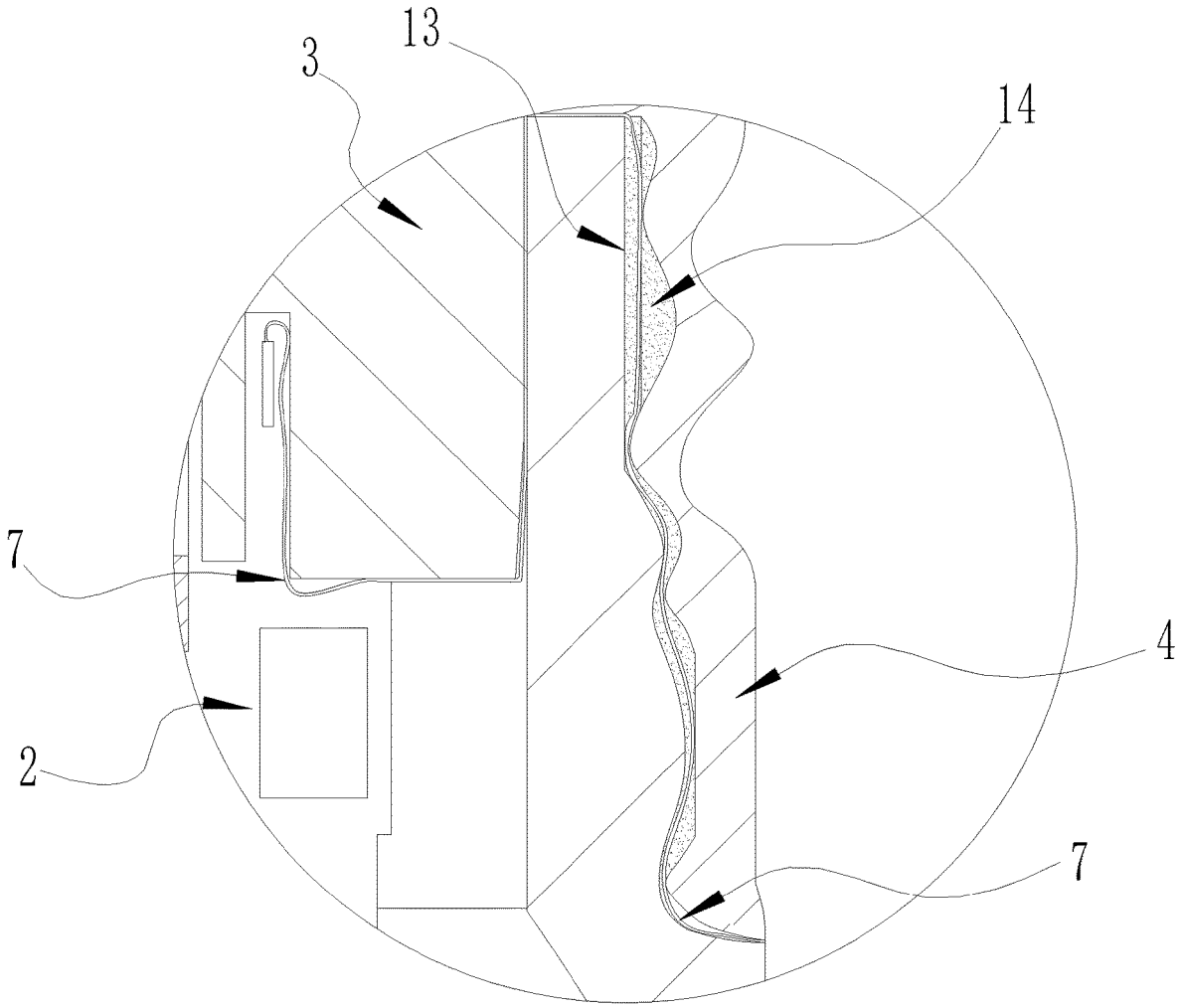
FIG. 4 is a partially enlarged structural schematic diagram of part A in FIG. 3.
Figure 5:
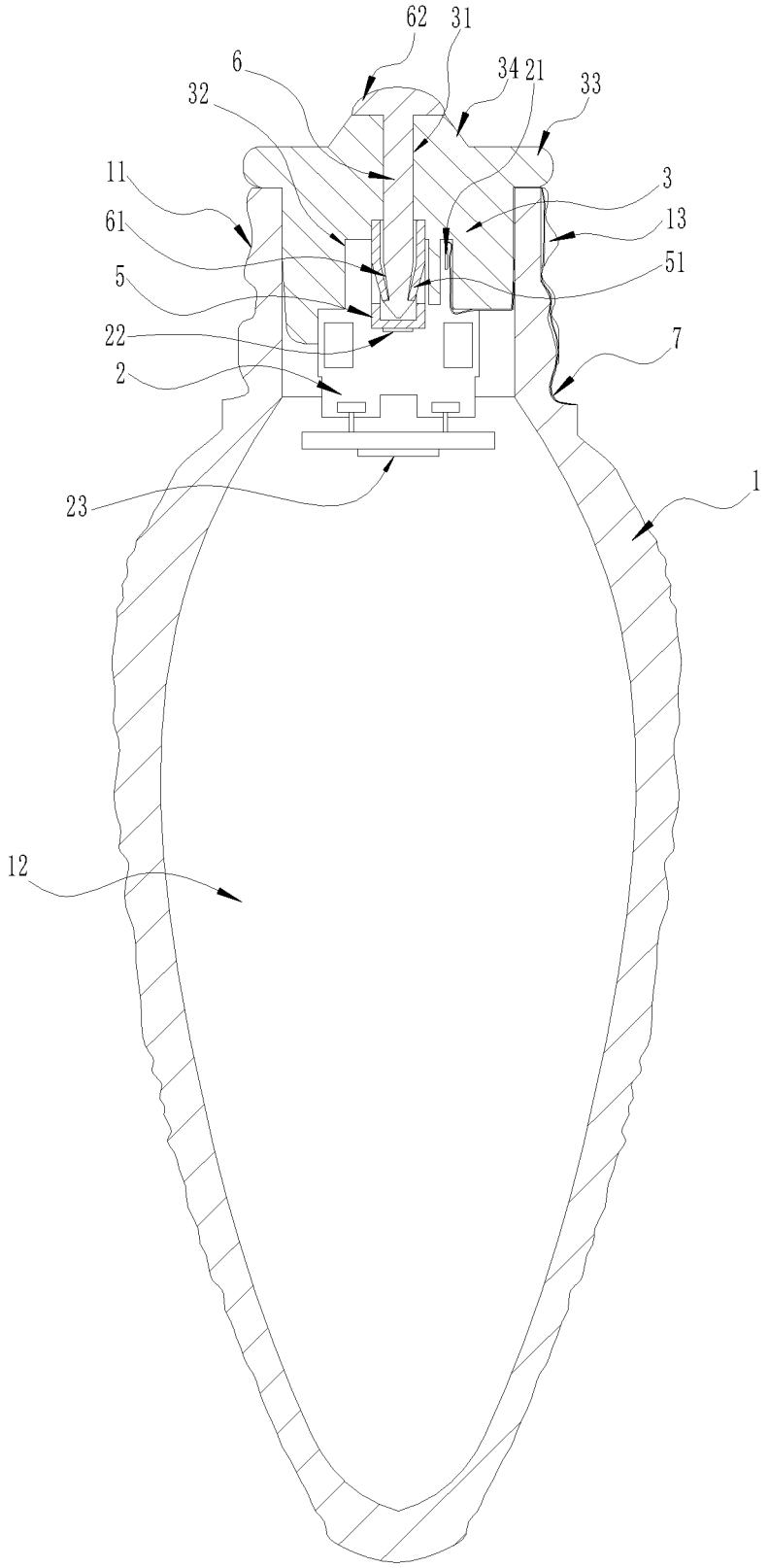
FIG. 5 is a cross-sectional structural schematic diagram of the structure shown in FIG. 3 without the lamp holder.

The present disclosure will be further described with more details below with reference to the drawings and embodiments of the present disclosure. It should be noted that, the following embodiments intend to illustrate rather than limit the scope of the present disclosure. Also, the following embodiments are parts of, but not all of, the embodiments of the present disclosure. Based on the embodiments of the present disclosure, all other embodiments derived by those of ordinary skills in the art without creative efforts fall within the scope of the present disclosure.

Embodiment 1

As shown in FIGS. 1-5, the present embodiment provides a waterproof lamp.

The waterproof lamp includes:

a lampshade 1, the lampshade 1 has a hollow structure with an open end and is internally provided with a light source installation cavity 12;

a light-emitting circuit board 2, the light-emitting circuit board 2 is arranged in the light source installation cavity 12 of the lampshade 1, a neutral wire inlet port 21 and a live wire inlet port 22, for connecting with a neutral wire and a live wire of a power supply, are arranged on a first end of the light-emitting circuit board 2, and a light emitting element 23 is arranged on a second end of the light-emitting circuit board 2;

a waterproof silicone washer 3, the waterproof silicone washer 3 is connected to the open end of the lampshade 1 and is fixedly connected to the light-emitting circuit board 2 to fix the light-emitting circuit board 2 in the light source installation cavity 12; and a lamp holder 4, the lamp holder 4 is mounted around an outer wall of the open end of the lampshade 1 to fasten the waterproof silicone washer 3 on the lampshade 1.

The waterproof lamp further includes:

a self-locking element 5 fixed on the live wire inlet port 22 of the light-emitting circuit board 2;

a first conductive element 6, the first conductive element 6 is rod-shaped, a first end of the first conductive element 6 is attached and fixed with the self-locking element 5 by insertion, a second end of the first conductive element 6 vertically passes through the waterproof silicone washer 3 and is exposed outside the waterproof silicone washer 3, the waterproof silicone washer 3 is correspondingly provided with a through hole 31 for the first conductive element 6 to pass through, the through hole 31 and a first part of the first conductive element 6 that passes through the through hole 31 have an interference fit, an end of the lamp holder 4 corresponding to the second end of the first conductive element 6 is provided with an avoidance hole 41, and an inner edge of the avoidance hole 41 is spaced with the second end of the first conductive element 6 to avoid mutual interference between the neutral wire and the live wire;

a second conductive element 7, the second conductive element 7 is made of conductive wire, a first end of the second conductive element 7 is fixedly connected to the neutral wire inlet port 21 of the light-emitting circuit board 2, and a second end of the second conductive element 7 is led out of the lampshade 1 and is electrically connected to the lamp holder 4.

As an optional implementation, further, the self-locking element 5 is tube-shaped and is made of a conductive material. An outer side of the self-locking element 5 is fixedly connected to the live wire inlet port 22 of the light-emitting circuit board 2, and the first end of the first conductive element 6 is attached and fixed in a tube structure of the self-locking element 5 by insertion. As a specific structural implementation, preferably, the self-locking element 5 is provided with an elastic engaging part 51. The elastic engaging part 51 obliquely extends along and gradually gets close to an axis of the self-locking element 5. A second part of the first conductive element 6 that passes through the self-locking element 5 is provided with a diminishing segment 61. The diminishing segment 61 is located close to a terminal of the second part of the first conductive element 6 that passes through the self-locking element 5. The diminishing segment 61 is engaged and locked with the elastic engaging part 51.

In this embodiment, the second end of the first conductive member 6 is mainly used to connect to the live wire. Therefore, in order to avoid the problem of poor contact, as an optional implementation, further, the second end of the first conductive member 6 is provided with a conductive portion 62. The conductive portion 62 has an curved structure, and the main function of the conductive portion 62 is to increase the contact area and avoid the problem of poor contact during the use of the lamp.

In order to improve the assembly process, as an optional implementation, further, in the present embodiment, the outer wall of the open end of the lampshade 1 is provided with external threads 11, an inner wall of the lamp holder 4 is provided with internal threads 42, and the lamp holder 4 is threaded on the outer wall of the open end of the lampshade 1 through the internal threads 42.

Since the main objective of the present disclosure is to provide a lamp with good waterproof performance, as an optional implementation, further, in the present embodiment, the waterproof silicone washer 3 includes a silicone washer main body. The silicone washer main body has a columnar structure. A first end of the silicone washer main body passes into an inner side of the open end of the lampshade 1, and the first end of the silicone washer main body is provided with a profiling insertion groove 32 matched with a structure of a first end of the light-emitting circuit board 2, and the first end of the light-emitting circuit board 2 is inserted into the profiling insertion groove 32. An outer wall of a second end of the silicone washer main body is provided with an annular extension portion 33 set on a terminal edge of the open end of the lampshade 1.

In order to prevent a condition where the conductive portion 62 of the first conductive element 6 is displaced during assembly or installation, causing short circuit as the conductive portion 62 electrically contacts the lamp holder 4, as a preferred embodiment, a center of the second end of the silicone washer main body of the waterproof silicone washer 3 is provided with a projection 34 corresponding to the avoidance hole 41 of the lamp holder 4. The projection 34 extends partially out of the avoidance hole 41. The second end of the first conductive element 6 passes through the projection 34 to be exposed outside the waterproof silicone washer 3.

As an optional implementation, further, the second conductive element 7 in the present disclosure may be made of copper, iron or aluminum. As an optional wiring method of the second conductive member 7, further, in the present disclosure, the second end of the second conductive element 7 is led out of the lampshade 1 from a gap between the outer wall of the silicone washer main body of the waterproof silicone washer 3 and the inner wall of the open end of the lampshade 1. Then, the second end of the second conductive element 7 passes through a gap between the inner wall of the lamp holder 4 and the outer wall of the open end of the lampshade 1 to be partially exposed outside the lamp holder 4. In the present embodiment, since the lamp holder 4 and the outer wall of the open end of the lampshade 1 are connected by threads, an avoiding groove 13 may be provided on the outer wall of the open end of the lampshade 1 to provide a gap for the second conductive element 7 to be led out. The end portion of the second conductive element 7 is exposed outside the lamp holder 4 and is fixed to the lamp holder 4 to achieve an electrical connection, so as to avoid the problem of poor contact between the second conductive element 7 and the lamp holder 4. Also, in order to improve the installation reliability of the lamp holder 4 and the lampshade 1, the inner wall of the lamp holder 4 can be glued first, then the lamp holder 4 is threaded on the open end of the lampshade 1 through the external threads 11, so as to form a sealing glue layer 14 and achieve sealing installation. Since the waterproof silicone washer 3 is made of silicone material which has resilience, when the lamp holder 4 is threaded and installed on the lampshade 1, the annular extension portion 33 of the waterproof silicone washer 3 will be pressed at a certain extent, so as to realize a tight sealing and matching effect between the lamp holder 4 and the waterproof silicone washer 3.

Figure 6:
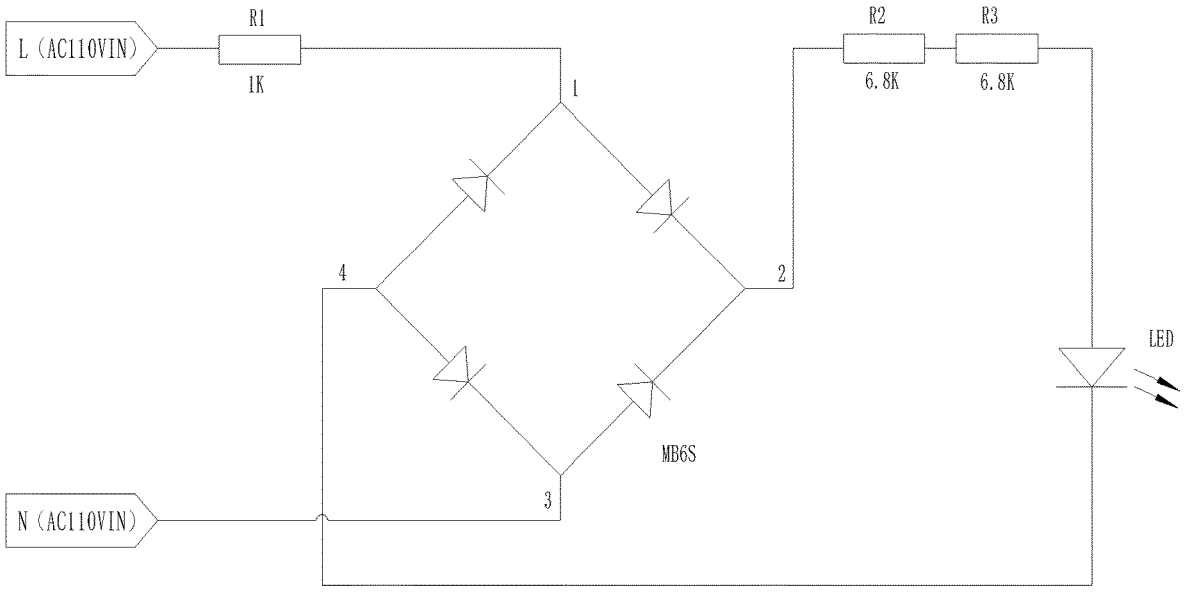
FIG. 6 is a circuit diagram of one of the implementations according to the first embodiment of the present disclosure.

Referring to FIG. 6, as an optional implementation of a circuit of the light emitting circuit board 2 mentioned in the present embodiment, specifically, the circuit includes a first resistor R1, a second resistor R2, a third resistor R3, a light emitting diode (LED), and a bridge rectifier MB6S. The first pin of the bridge rectifier MB6S is connected to a first end of the first resistor R1, and a second end of the first resistor R1 is connected to the live wire terminal L of the external power supply. According to the present disclosure, the self-locking element is connected to the second end of the first resistor R1, so the second end of the first resistor R1 can be connected to the live wire. In addition, the third pin of the bridge rectifier MB6S is connected to the neutral wire terminal N of the external power supply. The second pin of the bridge rectifier MB6S is connected in series with the second resistor R2, the third resistor R3, and the anode of the light emitting diode (LED) in sequence. The fourth pin of the bridge rectifier MB6S is connected to the cathode of the light emitting diode (LED).

Embodiment 2

Figure 7:
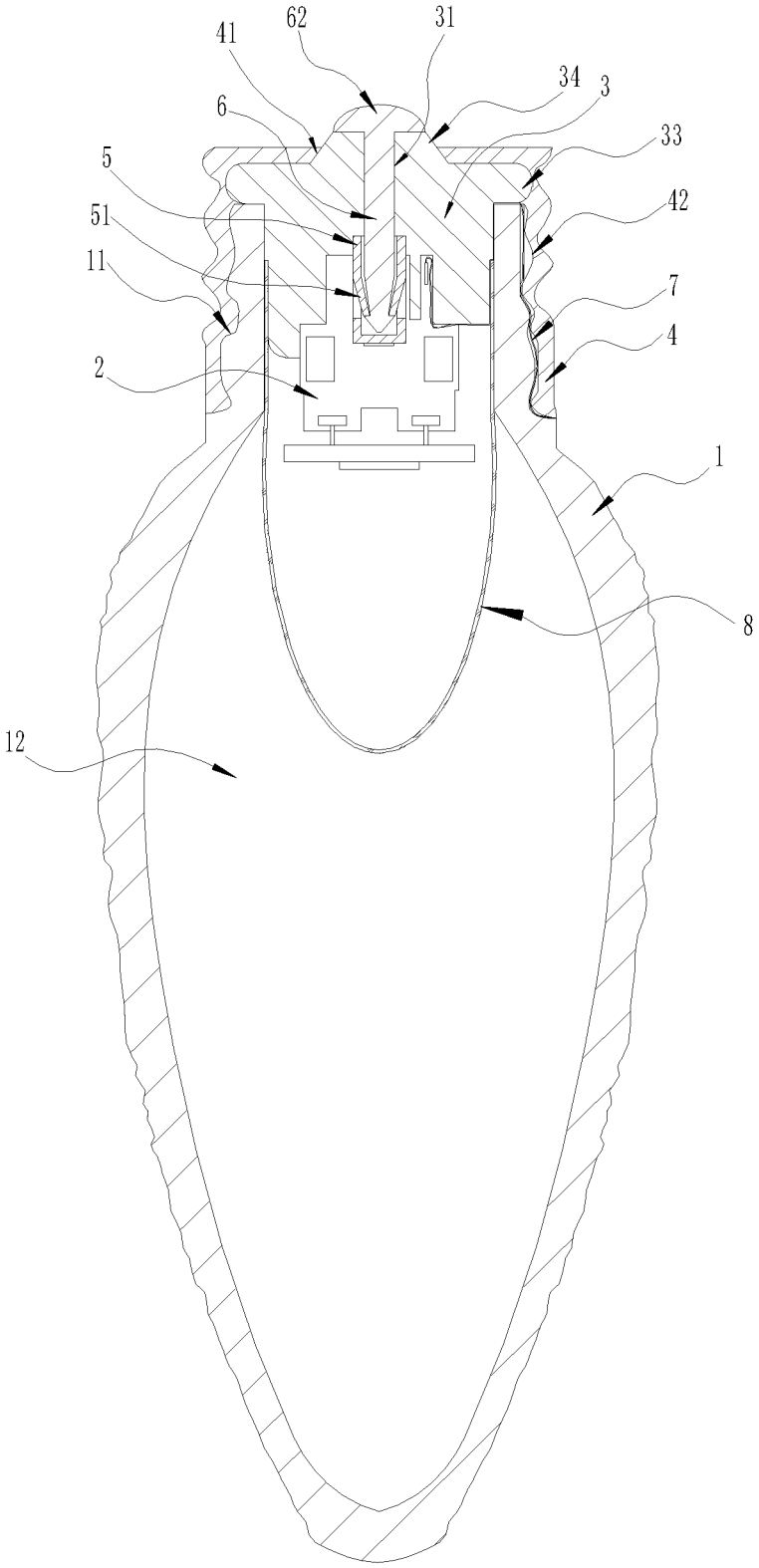
FIG. 7 is a cross-sectional structural schematic diagram according to a second embodiment of the present disclosure.

As shown in FIG. 7, the present embodiment is substantially the same as embodiment 1, and the difference is that in this embodiment, as a preferred optional implementation, the waterproof lamp further includes: an inner lens 8. The inner lens 8 is arranged inside the lampshade 1. An end of the inner lens 8 is connected and fixed on an outer wall of the first end of the silicone washer main body of the waterproof silicone washer 3 connected to the light-emitting circuit board 2. The light-emitting circuit board 2 is covered inside the inner lens 8.

The rest of the reference numerals not mentioned in this embodiment are substantially the same as those of embodiment 1, and will not be repeated here.

Embodiment 3

Figure 8:
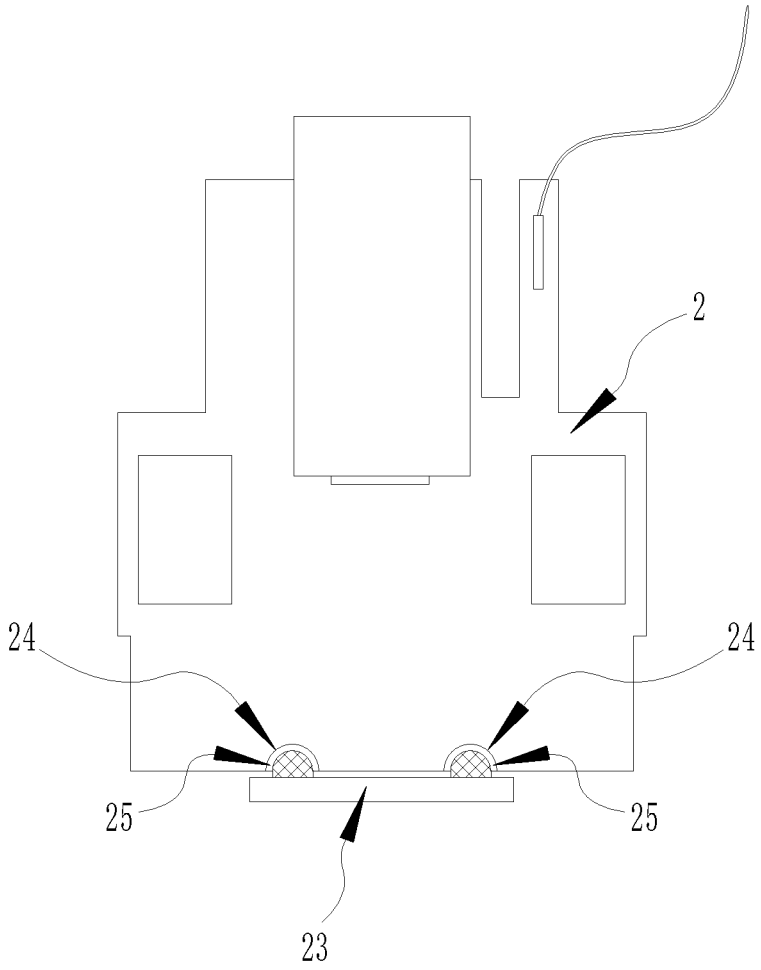
FIG. 8 is one schematic diagram according to a third embodiment of the present disclosure, in which the layout of the light-emitting circuit board is shown.
Figure 9:
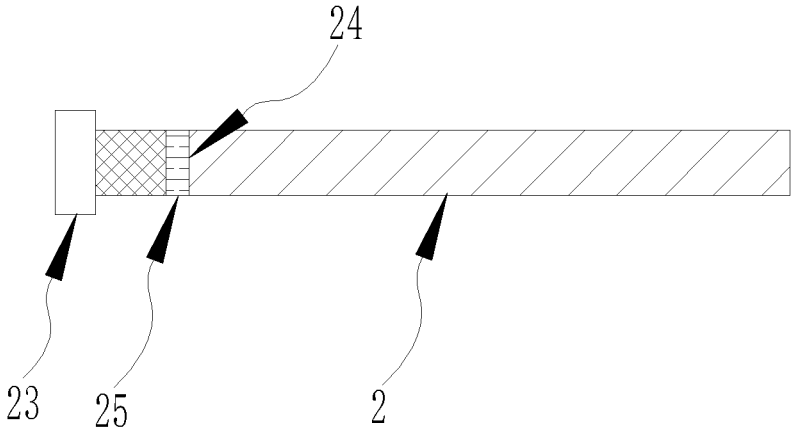
FIG. 9 is another schematic diagram according to the third embodiment of the present disclosure, in which the layout of the light-emitting circuit board is shown.

As shown in FIG. 8 or FIG. 9, the present embodiment is substantially the same as embodiment 1, and the difference is that in this embodiment, as a preferred optional implementation, further, the light-emitting element 23 is an LED lamp bead. An edge of the second end of the light-emitting circuit board 2 is provided with a pair of semi-circular through holes 24. The pair of semi-circular through holes 24 are each provided with a conductive film 25. The conductive films 25 in the pair of semi-circular through holes 24 are each connected to a power supply output end of the light-emitting circuit board 2. Specifically, the power supply output ends are positive terminal and negative terminal of the power supply output. The conductive films 25 in the pair of semi-circular through holes 24 are respectively and electrically connected to a positive pin and a negative pin of the LED lamp bead 23 in an one-to-one correspondence.

The rest of the reference numerals not mentioned in this embodiment are substantially the same as those of embodiment 1, and will not be repeated here.

The above descriptions merely include a part of the embodiments of the present disclosure and are not intended to limit the scope of the present disclosure. Any equivalent device or equivalent process transformed from the content of the description and drawings of the present disclosure, or directly or indirectly applied to other related technical fields is similarly included in the scope of the present disclosure.

What is claimed is:

1. A waterproof lamp bulb, comprising:

a hollow lampshade defining a cavity with an open end;

a circuit board arranged in the cavity of the lampshade, and including a neutral wire inlet port for connecting with a neutral wire, and a live wire inlet port for connecting with a live wire of a power supply, both wire inlet ports arranged on a first end of the circuit board;

a light emitting element arranged on a second end of the circuit board;

a silicone washer having a through hole, wherein the silicone washer is connected to the open end of the lampshade and is fixedly connected to the circuit board to fix the circuit board in the cavity;

a lamp holder including an avoidance hole corresponding with the through hole of the silicone washer, wherein the lamp holder is mounted around an outer wall of the lampshade at the open end, to fasten the silicone washer on the lampshade in a waterproof manner;

a self-locking element fixed to the live wire inlet port of the circuit board;

a rod-shaped first conductive element having first and second ends, the first end inserted through the through hole of the silicone washer with an interference fit and received in the self-locking element, the second end passes through the avoidance hole, such that an inner edge of the avoidance hole is spaced from the second end of the first conductive element; and a second conductive element made of conductive wire, and including a first end fixedly connected to the neutral wire inlet port of the circuit board, and a second end electrically connected to the lamp holder.

2. The waterproof lamp bulb according to claim 1, wherein the second end of the first conductive element is provided with a conductive portion having a curved structure.

3. The waterproof lamp bulb according to claim 1, wherein the outer wall of the open end of the lampshade is provided with external threads, and an inner wall of the lamp holder is provided with internal threads, wherein the lamp holder is threaded on the outer wall of the open end of the lampshade.

4. The waterproof lamp bulb according to claim 1, wherein the light-emitting element is light emitting diode, an edge of the second end of the circuit board is provided with a pair of semi-circular through holes, the pair of semi-circular through holes are each provided with a conductive film, the conductive films are each connected to a power supply output end of the circuit board, the conductive films are respectively and electrically connected to a positive pin and a negative pin of the light emitting diode in an one-to-one correspondence.

5. The waterproof lamp bulb according to claim 1, wherein the self-locking element is tube-shaped and made of a conductive material, and the first end of the first conductive element is attached and fixed in the self-locking element by insertion.

6. The waterproof lamp bulb according to claim 5, wherein the self-locking element includes an elastic engaging part, the elastic engaging part extending obliquely along and towards an axis of the self-locking element, the first end of the first conductive element provided with a segment with a diminishing diameter, the segment is engaged and locked with the elastic engaging part.

7. The waterproof lamp bulb according to claim 1, wherein the silicone washer comprises a main body, the main body has a columnar structure, a first end of the main body passes into an inner side of the open end of the lampshade, and the first end of the main body is provided with a profiling insertion groove matched with a structure of a first end of the circuit board, and the first end of the circuit board is inserted into the profiling insertion groove, an outer wall of a second end of the main body is provided with an annular extension portion set on a terminal edge of the open end of the lampshade.

8. The waterproof lamp bulb according to claim 7, wherein a center of the second end of the main body is provided with a projection corresponding to the avoidance hole of the lamp holder, the projection extends partially out of the avoidance hole, the second end of the first conductive element passes through the projection to be exposed outside the silicone washer.

9. The waterproof lamp bulb according to claim 7, wherein the second end of the second conductive element passes through a first gap between the outer wall of the main body and the inner wall of the open end of the lampshade, and through a second gap between the inner wall of the lamp holder and the outer wall of the open end of the lampshade to be partially exposed outside the lamp holder.

10. The waterproof lamp bulb according to claim 7 further comprising an inner lens arranged inside the lampshade, an end of the inner lens is connected and fixed on an outer wall of the first end of the silicone washer main body connected to the circuit board, and the circuit board is covered inside the inner lens.

* * * * *